US010026346B2

(12) United States Patent
Kim et al.

(10) Patent No.: US 10,026,346 B2
(45) Date of Patent: Jul. 17, 2018

(54) LUMINANCE DISTORTION COMPENSATING APPARATUS, METHOD OF COMPENSATING LUMINANCE DISTORTION USING THE SAME AND DISPLAY PANEL INSPECTING SYSTEM HAVING THE SAME

(71) Applicant: SAMSUNG DISPLAY CO., LTD., Yongin-si, Gyeonggi-Do (KR)

(72) Inventors: Se Yun Kim, Cheonan-si (KR); Hoi Sik Moon, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 103 days.

(21) Appl. No.: 15/143,078

(22) Filed: Apr. 29, 2016

(65) Prior Publication Data

US 2017/0186350 A1 Jun. 29, 2017

(30) Foreign Application Priority Data

Dec. 29, 2015 (KR) ..... 10-2015-0188679

(51) Int. Cl.

| | |
|---|---|
| ***G09G 3/00*** | (2006.01) |
| ***G09G 3/34*** | (2006.01) |
| ***G09G 3/36*** | (2006.01) |

(52) U.S. Cl.

CPC ..... *G09G 3/006* (2013.01); *G09G 3/3406* (2013.01); *G09G 3/36* (2013.01); *G09G 2320/0233* (2013.01); *G09G 2360/145* (2013.01)

(58) Field of Classification Search

CPC ..... G09G 3/006; G09G 2320/0233; G09G 2360/145; G09G 2320/0693

See application file for complete search history.

(56) References Cited

U.S. PATENT DOCUMENTS 8,184,924 B2 5/2012 Tsuruoka

*Primary Examiner* — Antonio A Caschera

(74) *Attorney, Agent, or Firm* — F. Chau & Associates, LLC

(57) ABSTRACT

A luminance distortion compensating apparatus includes an image data receiving circuit and a luminance distortion compensating circuit. The image data receiving circuit is configured to receive grayscale image data and full white image data displayed on a display panel. The luminance distortion compensating circuit is configured to compensate for a luminance distortion generated by a display panel inspecting apparatus inspecting the display panel, in the grayscale image data, using the grayscale image data and the full white image data. Thus, an inspection capability of a display panel inspecting system may be increased.

20 Claims, 12 Drawing Sheets

LUMINANCE DISTORTION COMPENSATING APPARATUS, METHOD OF COMPENSATING LUMINANCE DISTORTION USING THE SAME AND DISPLAY PANEL INSPECTING SYSTEM HAVING THE SAME

CROSS-REFERENCE TO RELATED APPLICATIONS

This application claims priority under 35 U.S.C. § 119 to Korean Patent Application No. 10-2015-0188679, filed on Dec. 29, 2015 in the Korean Intellectual Property Office (KIPO), the contents of which are herein incorporated by reference in their entireties.

TECHNICAL FILED

Exemplary embodiments of the present inventive concept relate to a display apparatus, and more particularly to a luminance distortion compensating apparatus, a method of compensating luminance distortion using the luminance distortion compensating apparatus, and a display panel inspecting system having the luminance distortion compensating apparatus.

DISCUSSION OF THE RELATED ART

After a display panel displaying an image is manufactured, an inspection process is generally performed on the display panel. The inspection process may cause one or more defects, such as spots. The spot defect may be a region of decreased luminance. This luminance decrease may be compensated for, however, general luminance distortions may result from the compensation.

SUMMARY

Exemplary embodiments of the present inventive concept provide a luminance distortion compensating apparatus capable of compensating for a luminance distortion that has been caused by a display panel inspecting apparatus which inspects a display panel.

Exemplary embodiments of the present inventive concept also provide a method of compensating for a luminance distortion using the above-mentioned luminance distortion compensating apparatus.

Exemplary embodiments of the present inventive concept also provide a display panel inspecting apparatus having the above-mentioned luminance distortion compensating apparatus.

According to an exemplary embodiment of the present inventive concept, a luminance distortion compensating apparatus includes an image data receiving circuit and a luminance distortion compensating circuit. The image data receiving circuit is configured to receive grayscale image data and full white image data displayed on a display panel. The luminance distortion compensating circuit is configured to compensate for a luminance distortion generated by a display panel inspecting apparatus inspecting the display panel, in the grayscale image data, using the grayscale image data and the full white image data.

In an exemplary embodiment of the present invention, the luminance distortion compensating circuit may receive the grayscale image data from the image data receiving circuit, may calculate a first average luminance value of the grayscale image data to output the first average luminance value of the grayscale image data, may receive the full white image data from the image data receiving circuit, may calculate a second average luminance value of the full white image data to output a reciprocal value of the second average luminance value, may perform a scaling on the full white image data such that a luminance of the full white image data corresponds to a luminance of the grayscale image data to output scaling image data, may output luminance trend line data of the scaling image data, may output luminance distortion data of the luminance distortion using the scaling image data and the luminance trend line data, and may output pre-processed image data in which the luminance distortion is compensated in the grayscale image data using the grayscale image data and the luminance distortion data.

In an exemplary embodiment of the present invention, the luminance distortion compensating circuit may include a first average luminance value calculating circuit configured to receive the grayscale image data from the image data receiving circuit, and to calculate the first average luminance value of the grayscale image data to output the first average luminance value of the grayscale image data.

In an exemplary embodiment of the present invention, the luminance distortion compensating circuit may further include a second average luminance value calculating circuit configured to receive the full white image data from the image data receiving circuit, and to calculate the second average luminance value of the full white image data to output the reciprocal value of the second average luminance value.

In an exemplary embodiment of the present invention, the luminance distortion compensating circuit may further include a scaling image data outputting circuit configured to perform the scaling on the full white image data such that the luminance of the full white image data corresponds to the luminance of the grayscale image data to output scaling image data.

In an exemplary embodiment of the present invention, the scaling image data outputting circuit may include a multiplexer configured to multiplex the first average luminance value of the grayscale image data, the reciprocal value of the second average luminance value of the full white image data and the full white image data to output the scaling image data.

In an exemplary embodiment of the present invention, the luminance distortion compensating circuit may further include a luminance trend line data generating circuit configured to receive the scaling image data, and to generate and output the luminance trend line data of the scaling image data to output the luminance trend line data of the scaling image data.

In an exemplary embodiment of the present invention, the luminance distortion compensating circuit may further include a luminance distortion extracting circuit configured to output the luminance distortion data of the luminance distortion using the scaling image data and the luminance trend line data.

In an exemplary embodiment of the present invention, the luminance distortion extracting circuit may include a subtractor configured to subtract the scaling image data from the luminance trend line data to output the luminance distortion data.

In an exemplary embodiment of the present invention, the luminance distortion compensating circuit may further include a compensating circuit configured to output the pre-processed image data in which the luminance distortion is compensated in the grayscale image data using the grayscale image data and the luminance distortion data.

In an exemplary embodiment of the present invention, the compensating circuit may include an adder configured to add the luminance distortion data to the grayscale image data to thereby output the pre-processed image data.

In an exemplary embodiment of the present invention, the image data receiving circuit may include a grayscale image data receiving circuit configured to receive the grayscale image data, and a full white image data receiving circuit configured to receive the full white image data.

In an exemplary embodiment of the present invention, the luminance distortion may be generated by a spot of a backlight unit included in the display panel inspecting apparatus, and the luminance distortion compensating circuit may compensate for the luminance distortion generated by the spot of the backlight unit.

In an exemplary embodiment of the present invention, the luminance distortion may be generated by a jig included in the display panel inspecting apparatus, and the luminance distortion compensating circuit may compensate for the luminance distortion generated by the jig.

According to an exemplary embodiment of the present inventive concept, a method of compensating for a luminance distortion includes receiving grayscale image data and full white image data displayed on a display panel, and compensating for a luminance distortion generated by a display panel inspecting apparatus inspecting the display panel, in the grayscale image data, using the grayscale image data and the full white image data.

In an exemplary embodiment of the present invention, the compensating for the luminance distortion may include calculating a first average luminance value of the grayscale image data to output the first average luminance value of the grayscale image data, calculating a second average luminance value of the full white image data to output a reciprocal value of the second average luminance value, performing a scaling on the full white image data such that a luminance of the full white image data corresponds to a luminance of the grayscale image data to output scaling image data, outputting luminance trend line data of the scaling image data, outputting luminance distortion data of the luminance distortion using the scaling image data and the luminance trend line data, and outputting pre-processed image data in which the luminance distortion is compensated in the grayscale image data using the grayscale image data and the luminance distortion data.

In an exemplary embodiment of the present invention, the luminance distortion may be generated by a spot of a backlight unit included in the display panel inspecting apparatus, and the compensating of the luminance distortion may include compensating for the luminance distortion generated by the spot of the backlight unit.

In an exemplary embodiment of the present invention, the luminance distortion may be generated by a jig included in the display panel inspecting apparatus, and the compensating of the luminance distortion may include compensating for the luminance distortion generated by the jig.

According to an exemplary embodiment of the present inventive concept, a display panel inspecting system includes a display panel, a display panel inspecting apparatus and a luminance distortion compensating apparatus. The display panel is configured to display an image. The display panel inspecting apparatus is configured to inspect the display panel. The luminance distortion compensating apparatus includes an image data receiving circuit configured to receive grayscale image data and full white image data displayed on a display panel, and a luminance distortion compensating circuit configured to compensate for a luminance distortion generated by the display panel inspecting apparatus, in the grayscale image data, using the grayscale image data and the full white image data.

In an exemplary embodiment of the present invention, the luminance distortion compensating circuit may receive the grayscale image data from the image data receiving circuit, may calculate a first average luminance value of the grayscale image data to output the first average luminance value of the grayscale image data, may receive the full white image data from the image data receiving circuit, may calculate a second average luminance value of the full white image data to output a reciprocal value of the second average luminance value, may perform a scaling on the full white image data such that a luminance of the full white image data corresponds to a luminance of the grayscale image data to output scaling image data, may output luminance trend line data of the scaling image data, may outputs luminance distortion data of the luminance distortion using the scaling image data and the luminance trend line data, and may output pre-processed image data in which the luminance distortion is compensated in the grayscale image data using the grayscale image data and the luminance distortion data.

According to an exemplary embodiment of the present inventive concept, a luminance distortion compensating apparatus eliminates a luminance distortion, caused by a display panel inspecting apparatus, from grayscale image data, and outputs pre-processed image data. Therefore, the luminance distortion caused by the display panel inspecting apparatus may be compensated. Thus, an inspection capability of the display panel inspecting system may be increased.

BRIEF DESCRIPTION OF THE DRAWINGS

The above and other features and aspects of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
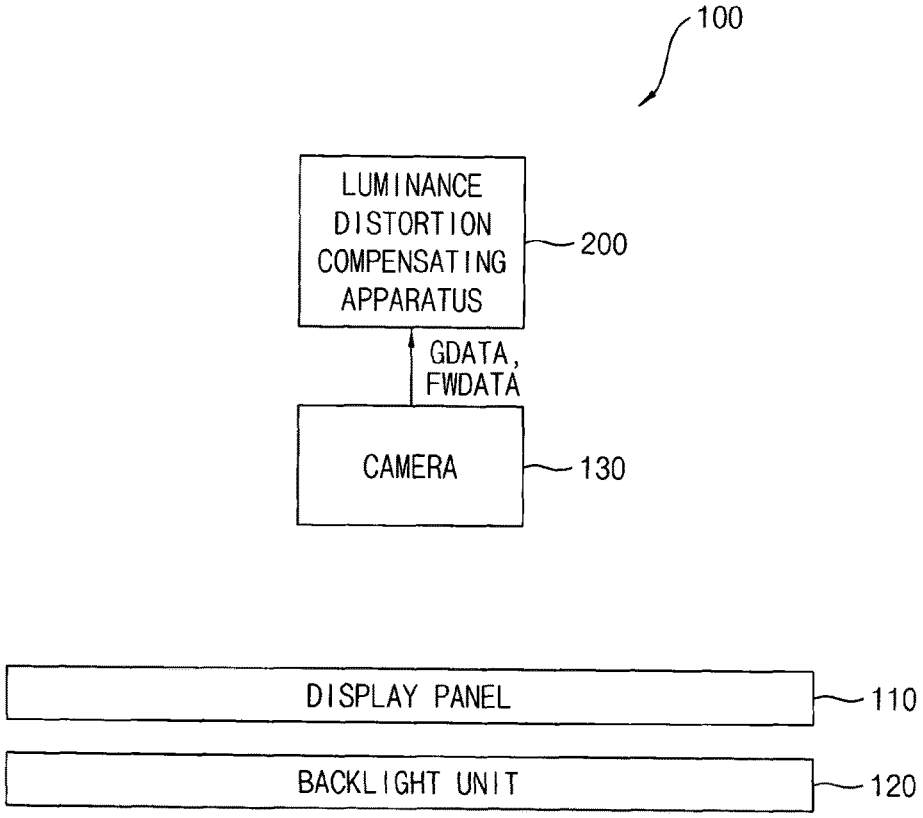
FIG. 1 is a block diagram illustrating a display panel inspecting system according to an exemplary embodiment of the present inventive concept.

FIG. 1 is a block diagram illustrating a display panel inspecting system according to an exemplary embodiment of the present inventive concept.

Referring to FIG. 1, the display panel inspecting system 100 according to an exemplary embodiment includes a display panel 110, a backlight unit 120, a camera 130 and a luminance distortion compensating apparatus 200.

The display panel 110 receives image data from an external source and displays an image. For example, the display panel 110 may be a liquid crystal display panel.

The backlight unit 120 is disposed under the display panel 110, and provides light to the display panel 110. For example, the backlight unit 120 may include a Light Emitting Diode (LED).

The camera 130 photographs the display panel 110. For example, the camera 130 photographs the image displayed on the display panel 110. The camera 130 outputs grayscale image data GDATA to the luminance distortion compensating apparatus 200 by photographing a grayscale image displayed on the display panel 110. The grayscale image may have grayscale values of 0 to 255. For example, the grayscale image may have a value of 24. In addition, the camera 130 outputs full white image data FWDATA to the luminance distortion compensating apparatus 200 by photographing a full white image displayed on the display panel 110. The full white image may have a grayscale value of 255, which would be the highest possible grayscale value.

Since the backlight unit 120 and the camera 130 are used in inspecting the display panel 110, the backlight unit 120 and the camera 130 may form a display panel inspecting apparatus. Although not shown, the display panel inspecting apparatus may further include a jig fixing the display panel 110.

The luminance distortion compensating apparatus 200 receives the grayscale image data GDATA and the full white image data FWDATA from the camera 130. The luminance distortion compensating apparatus 200 compensates for a luminance distortion generated by the display panel inspecting apparatus in the grayscale image data GDATA, using the grayscale image data GDATA and the full white image data FWDATA.

The luminance distortion detected by the display panel inspecting apparatus may be generated by a spot of the backlight unit 120 in the display panel inspecting apparatus. In addition, the luminance distortion detected by the display panel inspecting apparatus may be generated by the jig in the display panel inspecting apparatus. For example, when the jig fixing the display panel 110 covers a display area displaying the image in the display panel 110, the luminance distortion may be generated by the jig.

Figure 2:
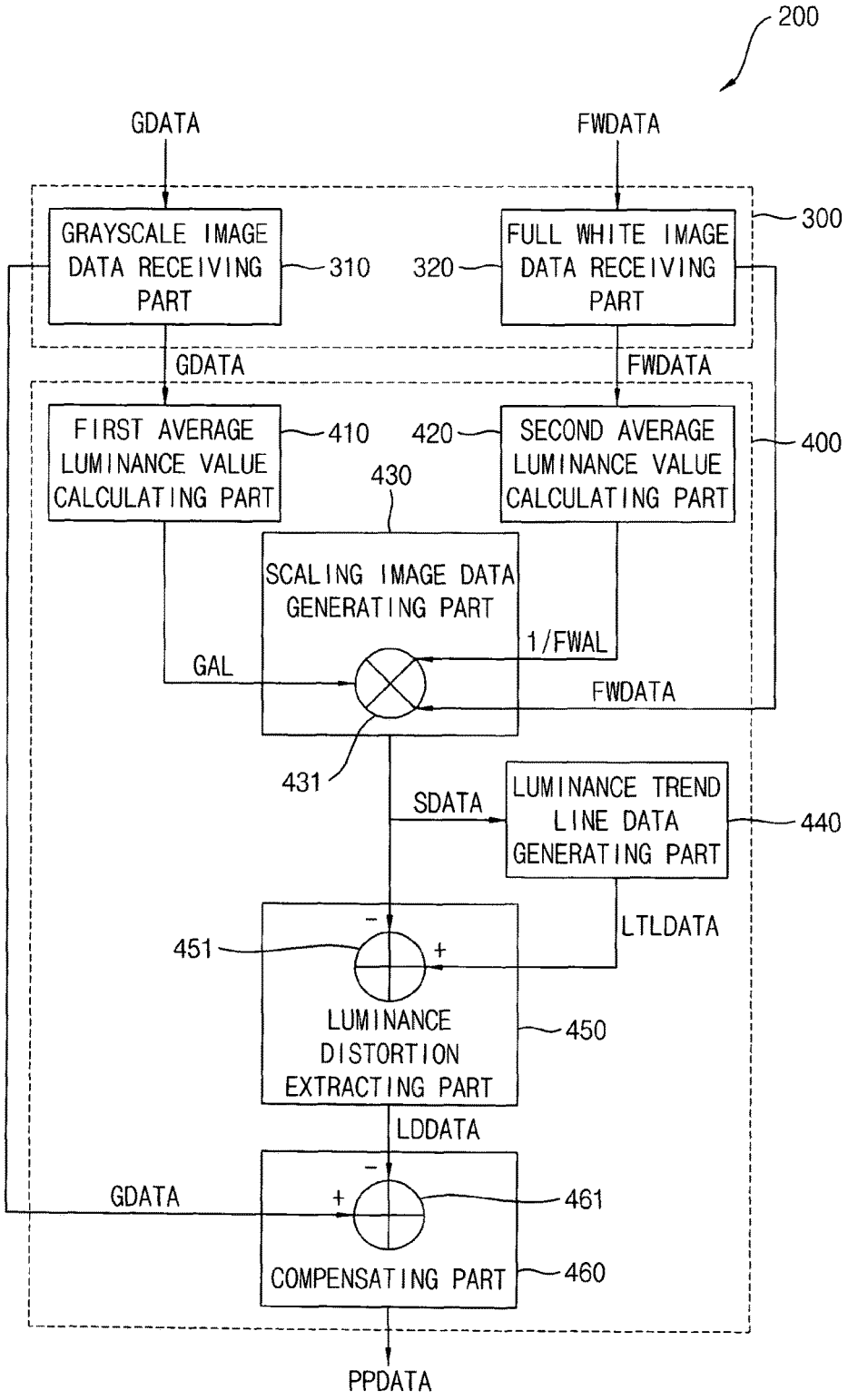
FIG. 2 is a block diagram illustrating a luminance distortion compensating apparatus of FIG. 1 according to an exemplary embodiment of the present inventive concept.

FIG. 2 is a block diagram illustrating the luminance distortion compensating apparatus 200 of FIG. 1.

Referring to FIGS. 1 and 2, the luminance distortion compensating apparatus 200 includes an image data receiving circuit 300 and a luminance distortion compensating circuit 400.

The image data receiving circuit 300 includes a grayscale image data receiving circuit 310 and a full white image data receiving circuit 320.

The grayscale image data receiving circuit 310 receives the grayscale image data GDATA from the camera 310. For example, a grayscale value of the grayscale image data GDATA may have a value of 24. The grayscale image data GDATA may include a luminance distortion caused by a spot of the display panel 110. In addition, the grayscale image data GDATA may include a luminance distortion caused by the display panel inspecting apparatus. The grayscale image data receiving circuit 310 outputs the grayscale image data GDATA to the luminance distortion compensating circuit 400.

The full white image data receiving circuit 320 receives the full white image data FWDATA from the camera 310. The full white image data FWDATA does not include the luminance distortion caused by the spot of the display panel 110, and includes the luminance distortion caused by the display panel inspecting apparatus. The full white image data receiving circuit 320 outputs the full white image data FWDATA to the luminance distortion compensating circuit 400.

The luminance distortion compensating circuit 400 includes a first average luminance value calculating circuit 410, a second average luminance value calculating circuit 420, a scaling image data generating circuit 430, a luminance trend line data generating circuit 440, a luminance distortion extracting circuit 450 and a compensating circuit 460.

The first average luminance value calculating circuit 410 receives the grayscale image data GDATA from the grayscale image data receiving circuit 310 of the image data receiving circuit 300. The first average luminance value calculating circuit 410 calculates a first average luminance value GAL of the grayscale image data GDATA to output the first average luminance value GAL of the grayscale image data GDATA.

The second average luminance value calculating circuit 420 receives the full white image data FWDATA from the full white image data receiving circuit 320 of the image data receiving circuit 300. The second average luminance value calculating circuit 420 calculates a second average luminance value FWAL of the full white image data FWDATA to output a reciprocal value 1/FWAL of the second average luminance value FWAL. For example, the second average luminance value FWAL of the full white image data FWDATA may be about 1000 nits.

The scaling image data generating circuit 430 performs a scaling on the full white image data FWDATA such that a luminance of the full white image data FWDATA corresponds to a luminance of the grayscale image data GDATA to output scaling image data SDATA.

For example, the scaling image data generating circuit 430 receives the first average luminance value GAL from the first average luminance value calculating circuit 410, receives the reciprocal value 1/FWAL of the second average luminance value FWAL from the second average luminance value calculating circuit 420, and receives the full white image data FWDATA from the full white image data receiving circuit 320. The scaling image data generating circuit 430 multiplexes the first average luminance value GAL, the reciprocal value 1/FWAL of the second average luminance value FWAL and the full white image data FWDATA to output the scaling image data SDATA. The scaling image data generating circuit 430 may include a multiplexer 431 which multiplexes the first average luminance value GAL, the reciprocal value 1/FWAL of the second average luminance value FWAL and the full white image data FWDATA to output the scaling image data SDATA.

For example, when a grayscale value of the grayscale image data GDATA has a grayscale value of about 24, a luminance value of the grayscale image data GDATA is about 100 nits, a grayscale value of the full white image data FWDATA is a grayscale value of about 255, and a luminance value of the full white image data FWDATA is about 1000 nits, a luminance of the scaling image data SDATA may be about 100 nits.

However, exemplary embodiments of the present invention are not limited to this approach. For example, the scaling image data generating circuit 430 may perform a scaling on the full white image data FWDATA such that the luminance of the full white image data FWDATA corresponds to the luminance of the grayscale image data GDATA for all grayscale values of the grayscale image data GDATA to output the scaling image data SDATA.

The luminance trend line data generating circuit 440 receives the scaling image data SDATA from the scaling image data generating circuit 430. The luminance trend line data generating circuit 440 generates and outputs luminance trend line data LTLDATA of the scaling image data SDATA. The luminance trend line data generating circuit 440 eliminates the luminance distortion caused by the display panel inspecting apparatus from the scaling image data SDATA to output the luminance trend line data LTLDATA. The luminance trend line data generating circuit 440 may generate the luminance trend line data LTLDATA of the scaling image data SDATA using a smoothing surface scheme such as B-Spline, Polynomial estimation and a low pass filtering.

The luminance distortion extracting circuit 450 receives the scaling image data SDATA from the scaling image data generating circuit 430. In addition, the luminance distortion extracting circuit 450 receives the luminance trend line data LTLDATA from the luminance trend line data generating circuit 440. The luminance distortion extracting circuit 450 subtracts the scaling image data SDATA from the luminance trend line data LTLDATA to output luminance distortion data LDDATA. The luminance distortion data LDDATA is the inverse of the luminance distortion caused by the display panel inspecting apparatus. The luminance distortion extracting circuit 450 may include a subtractor 451 subtracting the scaling image data SDATA from the luminance trend line data LTLDATA to output the luminance distortion data LDDATA.

The compensating circuit 460 receives the grayscale image data GDATA from the grayscale image data receiving circuit 310 of the image data receiving circuit 300. In addition, the compensating circuit 460 receives the luminance distortion data LDDATA from the luminance distortion extracting circuit 450. The compensating circuit 460 may include an adder 461 adding the luminance distortion data LDDATA to the grayscale image data GDATA to output pre-processed image data PPDATA. The luminance distortion data LDDATA is the inverse of the luminance distortion caused by the display panel inspecting apparatus, which is included in the grayscale image data, and thus the pre-processed image data PPDATA does not include the luminance distortion caused by the display panel inspecting apparatus. The pre-processed image data PPDATA may include the luminance distortion caused by the spot of the display panel 110. The pre-processed image data PPDATA may be output to an apparatus for compensating for the luminance distortion caused by the spot of the display panel 110.

Figure 3A:
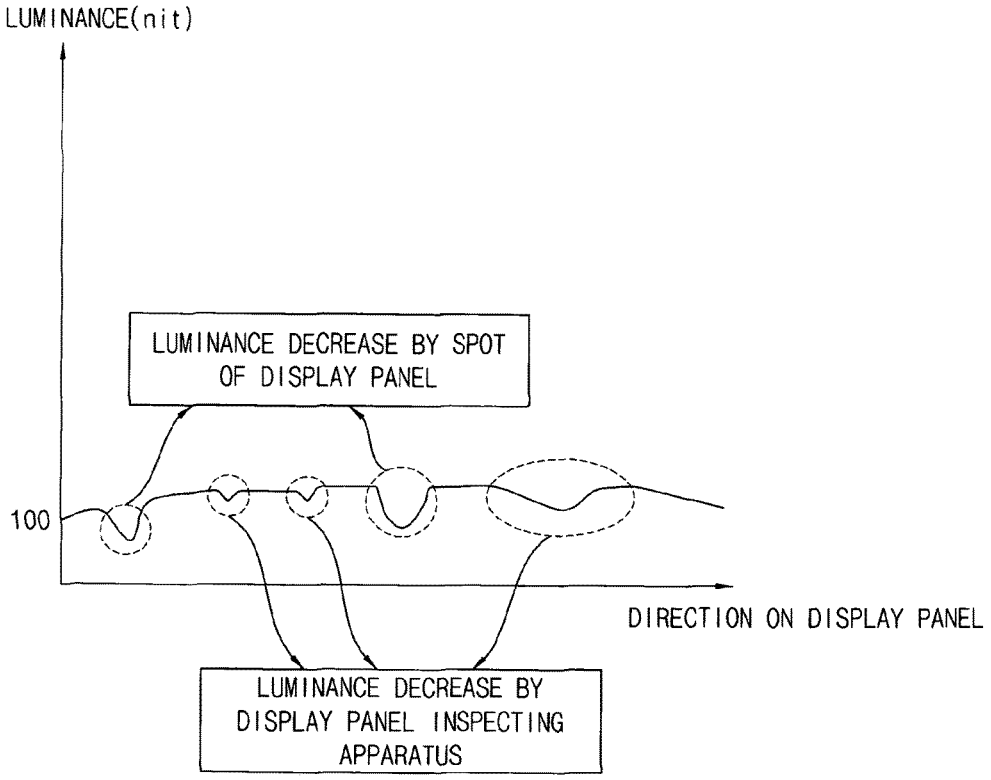
FIG. 3A is a graph illustrating a luminance of grayscale image data of FIG. 2 according to a direction on a display panel of FIG. 1.

FIG. 3A is a graph illustrating the luminance of the grayscale image data GDATA of FIG. 2 according to a direction on the display panel 110 of FIG. 1.

Referring to FIGS. 1 to 3A, the first average luminance value GAL of the grayscale image data GDATA may be about 100 nits. The grayscale image data GDATA may include the luminance distortion caused by the spot of the display panel 110. Thus, the luminance of the grayscale image data GDATA may be decreased by the spot of the display panel 110. In addition, the grayscale image data GDATA may include the luminance distortion caused by the display panel inspecting apparatus. Thus, the luminance of the grayscale image data GDATA may be decreased by the display panel inspecting apparatus.

Figure 3B:
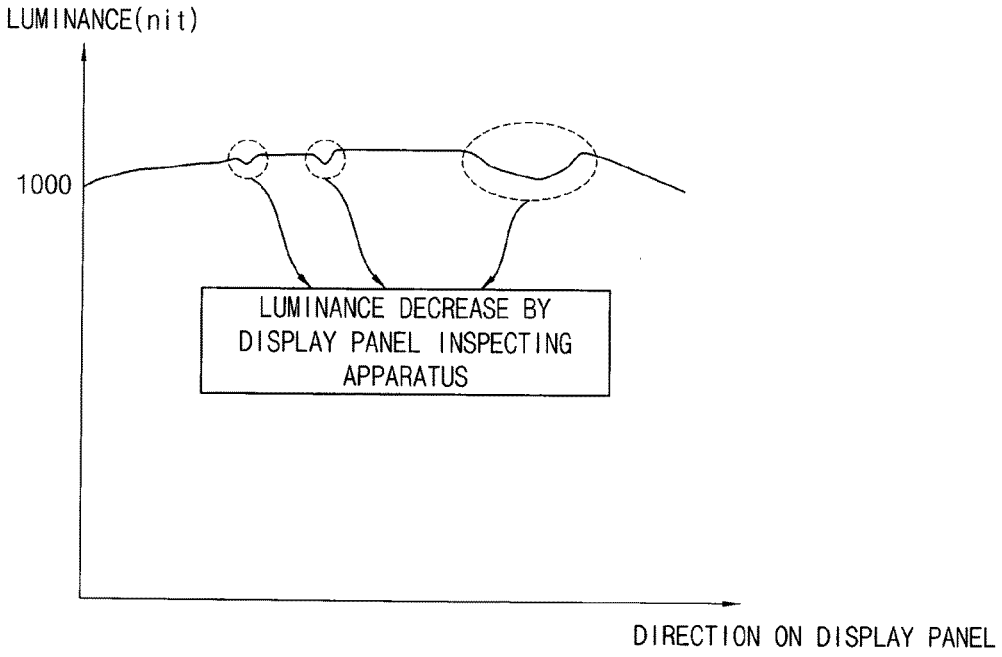
FIG. 3B is a graph illustrating a luminance of the full white image data of FIG. 2 according to the direction on the display panel of FIG. 1.

FIG. 3B is a graph illustrating the luminance of the full white image data FWDATA of FIG. 2 according to the direction on the display panel 110 of FIG. 1.

Referring to FIGS. 1 to 3B, the second average luminance value FWAL of the full white image data FWDATA may be about 1000 nits. The full white image data FWDATA may include the luminance distortion caused by the display panel inspecting apparatus. Thus, the luminance of the full white image data FWDATA may be decreased by the display panel inspecting apparatus.

Figure 3C:
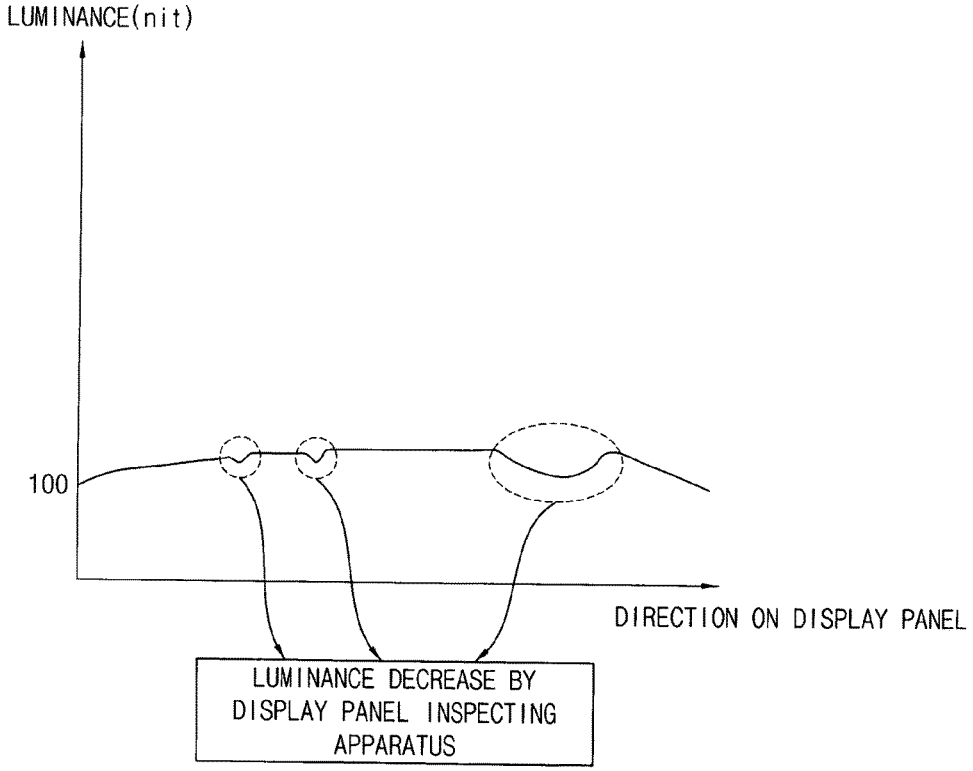
FIG. 3C is a graph illustrating a luminance of scaling image data of FIG. 2 according to the direction on the display panel of FIG. 1.

FIG. 3C is a graph illustrating the luminance of the scaling image data SDATA of FIG. 2 according to the direction on the display panel 110 of FIG. 1.

Referring to FIGS. 1 to 3, since the scaling image data SDATA is generated by performing the scaling on the full white image data FWDATA such that the luminance of the full white image data FWDATA corresponds to the luminance of the grayscale image data GDATA, the average luminance value of the scaling image data SDATA may be about 100 nits. The scaling image data SDATA may have the luminance distortion caused by the display panel inspecting apparatus. Thus, the luminance of the scaling image data SDATA may be decreased by the display panel inspecting apparatus.

Figure 3D:
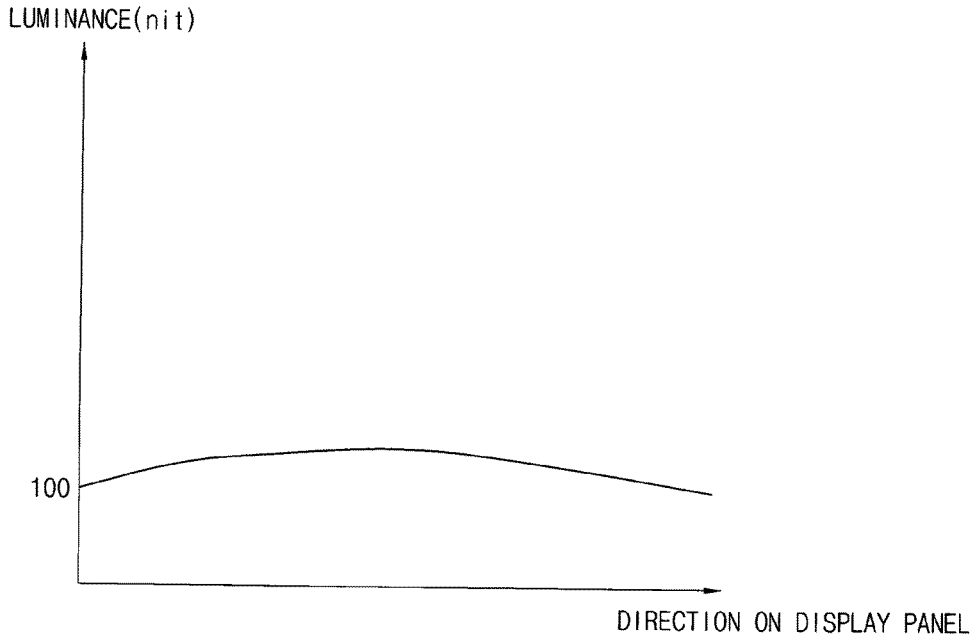
FIG. 3D is a graph illustrating a luminance trend line data of the scaling image data of FIG. 2 according to the direction on the display panel of FIG. 1.

FIG. 3D is a graph illustrating the luminance trend line data LTLDATA of the scaling image data SDATA of FIG. 2 according to the direction on the display panel 110 of FIG. 1.

Referring to FIGS. 1 to 3D, the average luminance value of the luminance trend line data LTLDATA may be about 100 nits. The luminance trend line data LTLDATA is generated by eliminating the luminance distortion caused by the display panel inspecting apparatus from the scaling image data SDATA. Thus, the luminance trend line data LTLDATA does not include the luminance distortion caused by the display panel inspecting apparatus.

Figure 3E:
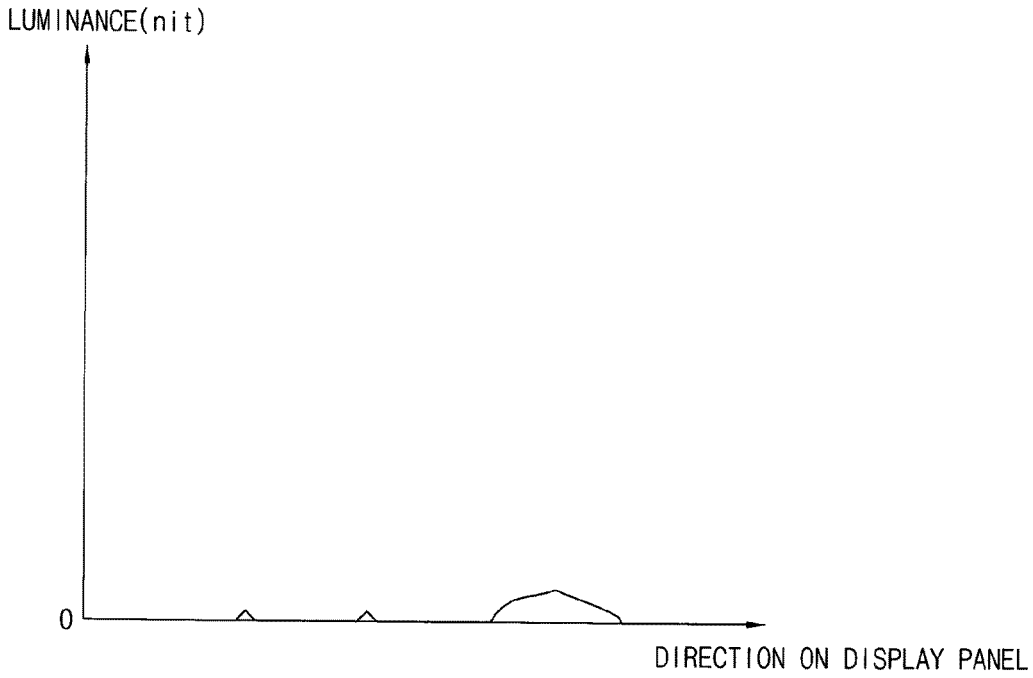
FIG. 3E is a graph illustrating a luminance of luminance distortion data of FIG. 2 according to the direction on the display panel of FIG. 1.

FIG. 3E is a graph illustrating the luminance of the luminance distortion data LDDATA of FIG. 2 according to the direction on the display panel 110 of FIG. 1.

Referring to FIGS. 1 to 3E, since the luminance distortion data LDDATA is generated by subtracting the scaling image data SDATA from the luminance trend line data LTLDATA, the average luminance value of the luminance distortion data LDDATA may be about 0 nit, and the luminance distortion data LDDATA is the inverse of the luminance distortion caused by the display panel inspecting apparatus.

Figure 3F:
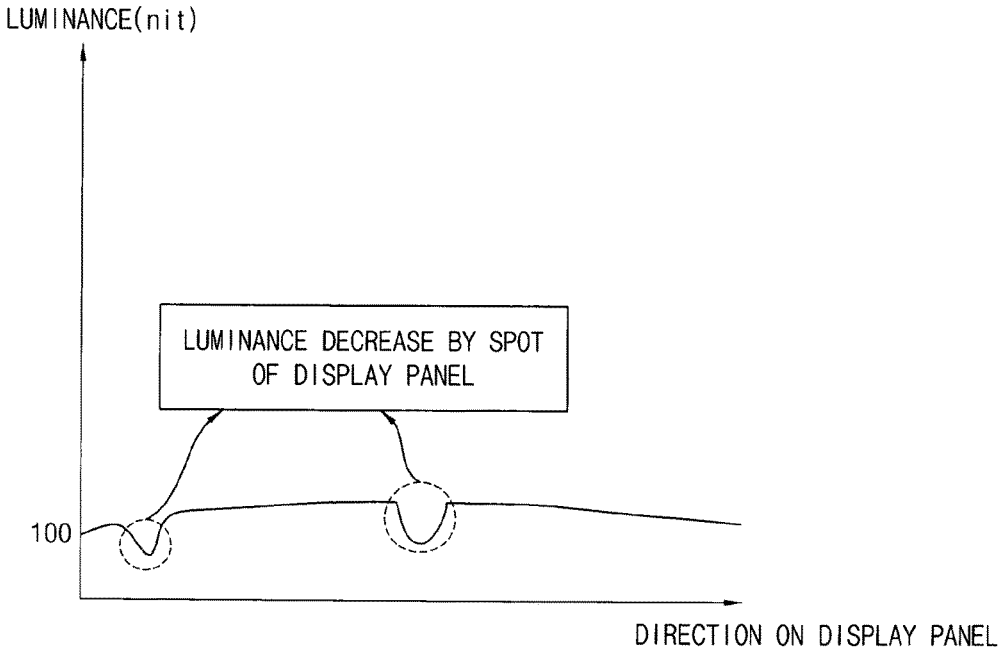
FIG. 3F is a graph illustrating a luminance of pre-processed image data of FIG. 2 according to the direction on the display panel of FIG. 1.

FIG. 3F is a graph illustrating the luminance of the pre-processed image data PPDATA of FIG. 2 according to the direction on the display panel 110 of FIG. 1.

Referring to FIGS. 1 to 3F, since the pre-processed image data PPDATA is generated by adding the luminance distortion data LDDATA to the grayscale image data GDATA, the average luminance value of the pre-processed image data PPDATA may be about 100 nits, and the pre-processed image data PPDATA does not include the luminance distortion caused by the display panel inspecting apparatus. The pre-processed image data PPDATA may include the luminance distortion caused by the spot of the display panel 110, and the pre-processed image data PPDATA may be output to the apparatus for compensating the luminance distortion caused by the spot of the display panel 110.

Figure 4A:
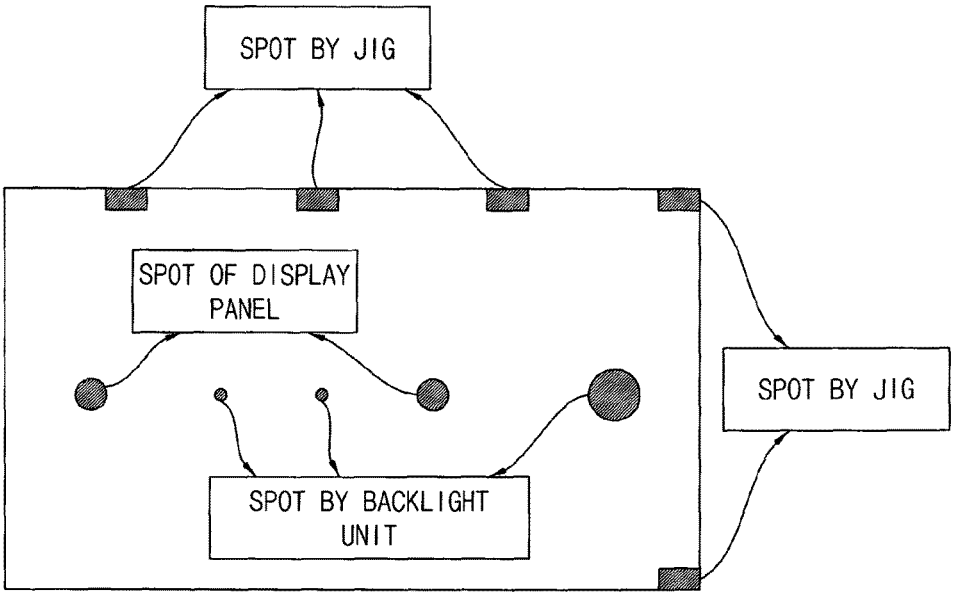
FIG. 4A is a screen illustrating the grayscale image data of FIG. 2.

FIG. 4A is a screen illustrating the grayscale image data GDATA of FIG. 2.

Referring to FIGS. 1 to 4A, the grayscale image data GDATA may include the spot of the display panel 110 and the spot caused by the display panel inspecting apparatus. The spot caused by the display panel inspecting apparatus may include the spot cause by the backlight unit 120 and the spot caused by the jig. Thus, the grayscale image data GDATA includes the luminance distortion caused by the spot of the display panel 110 and the luminance distortion caused by the display panel inspecting apparatus.

Figure 4B:
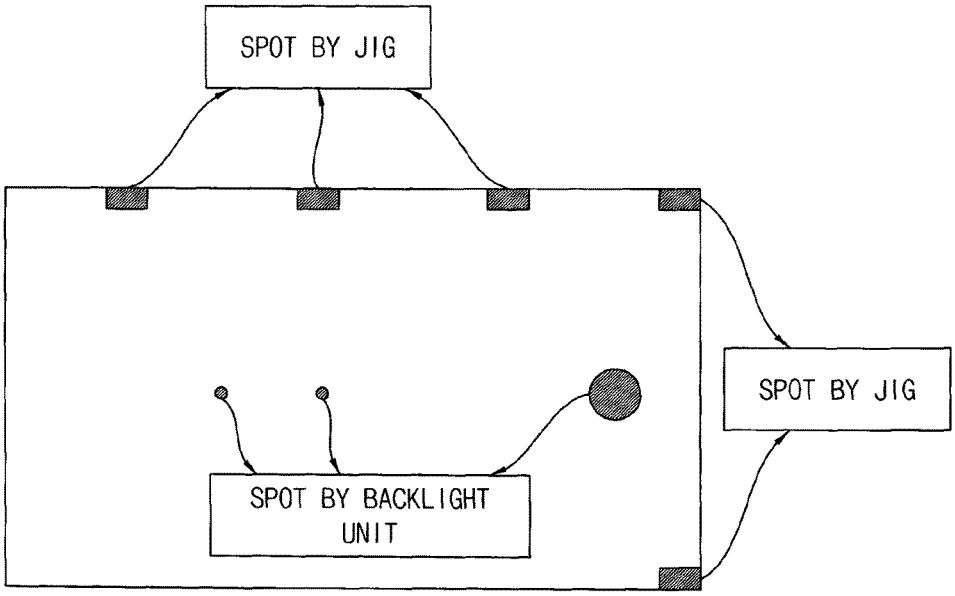
FIG. 4B is a screen illustrating the full white image data of FIG. 2.

FIG. 4B is a screen illustrating the full white image data FWDATA of FIG. 2.

Referring to FIGS. 1 to 4B, the full white image data FWDATA might not include the spot of the display panel 110, and may include the spot caused by the display panel inspecting apparatus. The spot caused by the display panel inspecting apparatus may include the spot caused by the backlight unit 120 and the spot caused by the jig. Thus, the full white image data FWDATA does not include the luminance distortion caused by the spot of the display panel 110 and includes the luminance distortion caused by the display panel inspecting apparatus.

Figure 4C:
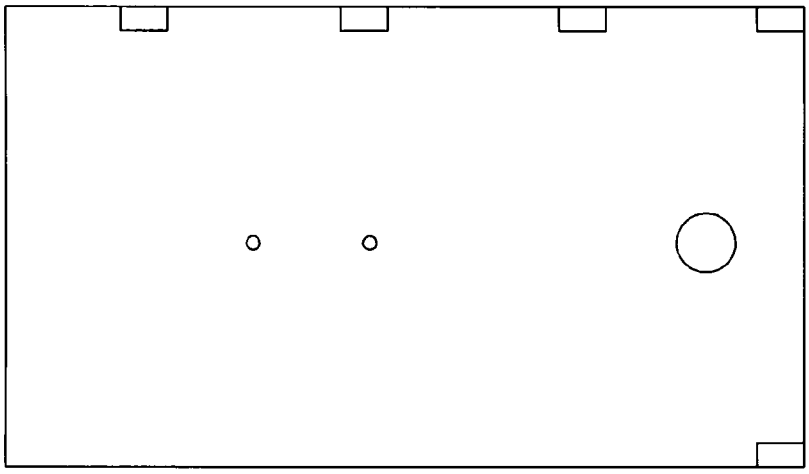
FIG. 4C is a screen illustrating the luminance distortion data of FIG. 2.

FIG. 4C is a screen illustrating the luminance distortion data LDDATA of FIG. 2.

Referring to FIGS. 1 to 4C, since the luminance distortion data LDDATA is generated by subtracting the scaling image data SDATA from the luminance trend line data LTLDATA, the luminance distortion data LDDATA is the inverse of the luminance distortion caused by the display panel inspecting apparatus.

Figure 4D:
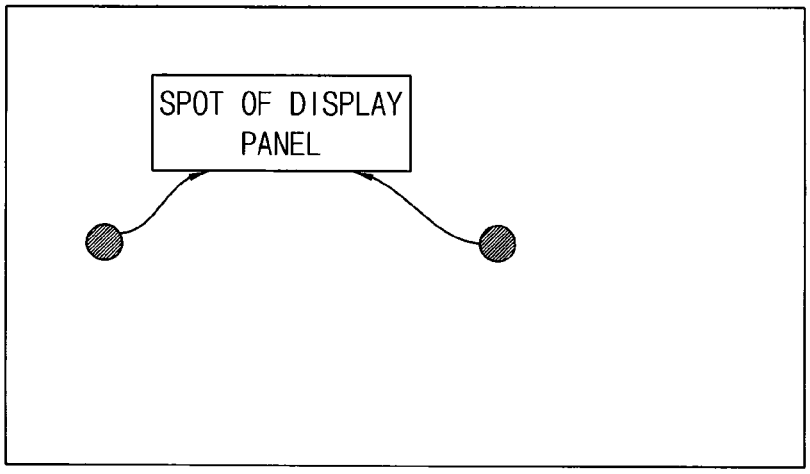
FIG. 4D is a screen illustrating the pre-processed image data of FIG. 2.

FIG. 4D is a screen illustrating the pre-processed image data PPDATA of FIG. 2.

Referring to FIGS. 1 to 4D, since the pre-processed image data PPDATA is generated by adding the luminance distortion data LDDATA to the grayscale image data GDATA, the pre-processed image data PPDATA does not include the spot caused by the display panel inspecting apparatus. The pre-processed image data PPDATA may include the luminance distortion caused by the spot of the display panel 110, and the pre-processed image data PPDATA may be output to the apparatus for compensating the luminance distortion caused by the spot of the display panel 110.

Figure 5A:
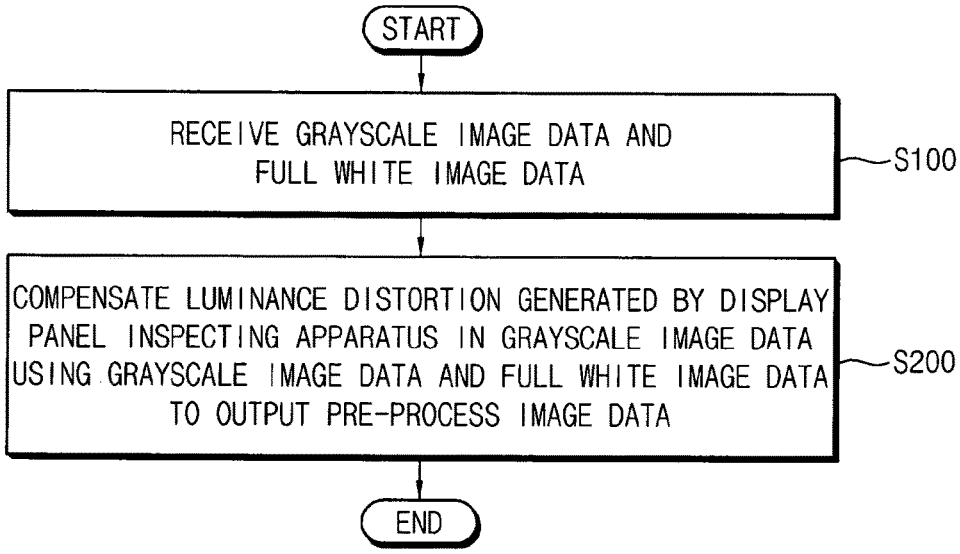
FIGS. 5A, 5B and 5C are flow charts illustrating a method of compensating for a luminance distortion using the luminance distortion compensating apparatus of FIGS. 1 and 2 according to an exemplary embodiment of the present inventive concept.
Figure 5B:
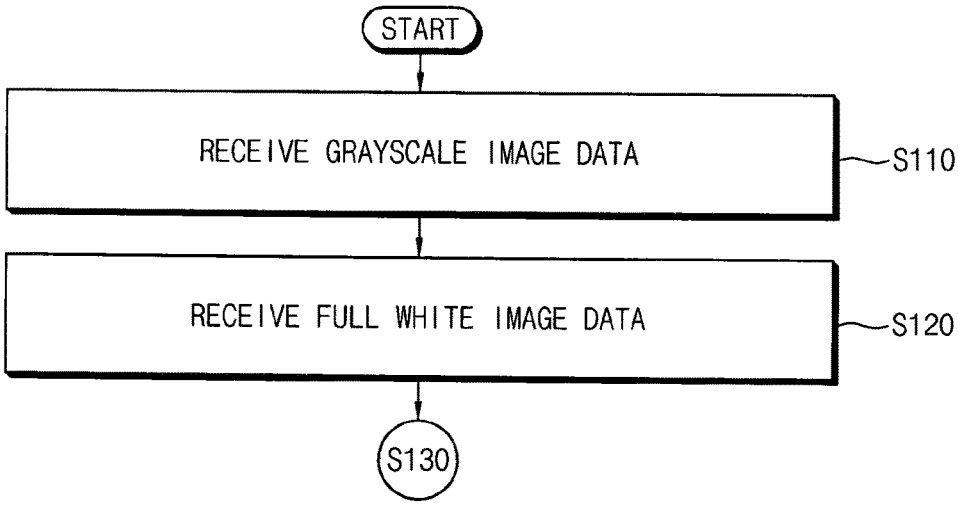
Figure 5C:
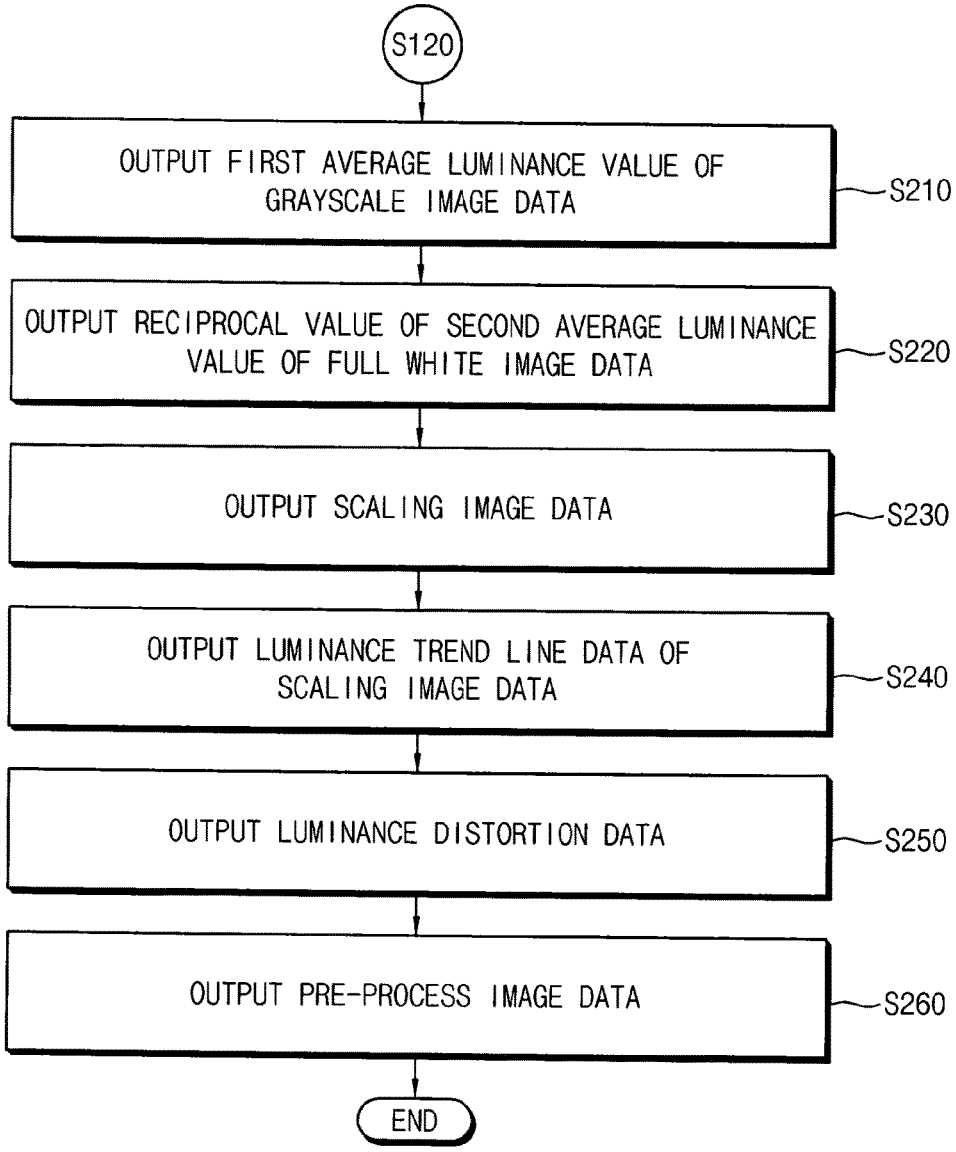

FIGS. 5A, 5B and 5C are flow charts illustrating a method of compensating for a luminance distortion using the luminance distortion compensating apparatus 200 of FIGS. 1 and 2.

Referring to FIGS. 1 to 5C, the grayscale image data GDATA and the full white image data FWDATA are received (step S100).

For example, the grayscale image data GDATA is received (step S110). The grayscale image data receiving circuit 310 of the image data receiving circuit 300 receives the grayscale image data GDATA from the camera 310. For example, the grayscale value of the grayscale image data GDATA may be a grayscale value of 24. The grayscale image data GDATA may include the luminance distortion caused by the spot of the display panel 110. In addition, the grayscale image data GDATA may include the luminance distortion caused by the display panel inspecting apparatus. The luminance distortion caused by the display panel inspecting apparatus may be generated by the spot of the backlight unit 120 in the display panel inspecting apparatus. In addition, the luminance distortion caused by the display panel inspecting apparatus may be generated by the jig.

The full white image data FWDATA is received (step S120). The full white image data receiving circuit 320 of the image data receiving circuit 300 receives the full white image data FWDATA from the camera 310. The full white image data FWDATA does not include the luminance distortion caused by the spot of the display panel 110, and includes the luminance distortion caused by the display panel inspecting apparatus.

The pre-processed image data PPDATA is output by compensating for the luminance distortion generated by the display panel inspecting apparatus in the grayscale image data GDATA, using the grayscale image data GDATA and the full white image data FWDATA (step S200).

For example, the first average luminance value GAL of the grayscale image data GDATA is output (step S210). The first average luminance value calculating circuit 410 receives the grayscale image data GDATA from the grayscale image data receiving circuit 310 of the image data receiving circuit 300. The first average luminance value calculating circuit 410 calculates the first average luminance value GAL of the grayscale image data GDATA to output the first average luminance value GAL of the grayscale image data GDATA. For example, the first average luminance value GAL of the grayscale image data GDATA may be about 100 nits.

The reciprocal value 1/FWAL of the second average luminance value FWAL of the full white image data FWDATA is output (step S220). The second average luminance value calculating circuit 420 receives the full white image data FWDATA from the full white image data receiving circuit 320 of the image data receiving circuit 300. The second average luminance value calculating circuit 420 calculates the second average luminance value FWAL of the full white image data FWDATA to output the reciprocal value 1/FWAL of the second average luminance value FWAL. For example, the second average luminance value FWAL of the full white image data FWDATA may be about 1000 nits.

The scaling image data SDATA is output (step S230). The scaling image data generating circuit 430 performs the scaling on the full white image data FWDATA such that the luminance of the full white image data FWDATA corresponds to the luminance of the grayscale image data GDATA to output the scaling image data SDATA.

The scaling image data generating circuit 430 receives the first average luminance value GAL from the first average luminance value calculating circuit 410, receives the reciprocal value 1/FWAL of the second average luminance value FWAL from the second average luminance value calculating circuit 420, and receives the full white image data FWDATA from the full white image data receiving circuit 320. The scaling image data generating circuit 430 multiplexes the first average luminance value GAL, the reciprocal value 1/FWAL of the second average luminance value FWAL and the full white image data FWDATA to output the scaling image data SDATA. The scaling image data generating circuit 430 may include the multiplexer which multiplexes the first average luminance value GAL, the reciprocal value 1/FWAL of the second average luminance value FWAL and the full white image data FWDATA to output the scaling image data SDATA.

For example, when the grayscale value of the grayscale image data GDATA has a grayscale value of about 24, the luminance value of the grayscale image data GDATA is about 100 nits, the grayscale value of the full white image data FWDATA is a grayscale value of about 255, and the luminance value of the full white image data FWDATA is about 1000 nits, the luminance of the scaling image data SDATA may be about 100 nits.

However, the present exemplary embodiment is not limited thereto. The scaling image data generating circuit 430 may perform the scaling on the full white image data FWDATA such that the luminance of the full white image data FWDATA corresponds to the luminance of the grayscale image data GDATA for all grayscale values of the grayscale image data GDATA to output the scaling image data SDATA.

The luminance trend line data LTLDATA of the scaling image data SDATA is output (step S240). The luminance trend line data generating circuit 440 receives the scaling image data SDATA from the scaling image data generating circuit 430. The luminance trend line data generating circuit 440 generates and outputs the luminance trend line data LTLDATA of the scaling image data SDATA. The luminance trend line data generating circuit 440 eliminates the luminance distortion caused by the display panel inspecting apparatus from the scaling image data SDATA to output the luminance trend line data LTLDATA. The luminance trend line data generating circuit 440 may generate the luminance trend line data LTLDATA of the scaling image data SDATA using the smoothing surface scheme such as B-Spline, Polynomial estimation and a low pass filtering.

The luminance distortion data LDDATA is output (step S250). The luminance distortion extracting circuit 450 receives the scaling image data SDATA from the scaling image data generating circuit 430. In addition, the luminance distortion extracting circuit 450 receives the luminance trend line data LTLDATA from the luminance trend line data generating circuit 440. The luminance distortion extracting circuit 450 subtracts the scaling image data SDATA from the luminance trend line data LTLDATA to output the luminance distortion data LDDATA. The luminance distortion data LDDATA is the inverse of the luminance distortion caused by the display panel inspecting apparatus. The luminance distortion extracting circuit 450 may include the subtractor subtracting the scaling image data SDATA from the luminance trend line data LTLDATA to output the luminance distortion data LDDATA.

The pre-processed image data PPDATA is output (step S260). The compensating circuit 460 receives the grayscale image data GDATA from the grayscale image data receiving circuit 310 of the image data receiving circuit 300. In addition, the compensating circuit 460 receives the luminance distortion data LDDATA from the luminance distortion extracting circuit 450. The compensating circuit 460 adds the luminance distortion data LDDATA to the grayscale image data GDATA to output the pre-processed image data PPDATA. The luminance distortion data LDDATA is the inverse of the luminance distortion caused by the display panel inspecting apparatus, which is included in the grayscale image data, and thus the pre-processed image data PPDATA does not include the luminance distortion caused by the display panel inspecting apparatus. The pre-processed image data PPDATA may include the luminance distortion caused by the spot of the display panel 110. The pre-processed image data PPDATA may be output to the apparatus for compensating the luminance distortion caused by the spot of the display panel 110.

According to the present exemplary embodiment of the present invention, the luminance distortion compensating apparatus 200 eliminates the luminance distortion caused by the display panel inspecting apparatus from the grayscale image data GDATA, and outputs the pre-processed image data PPDATA. Therefore, the luminance distortion caused by the display panel inspecting apparatus may be compensated. Thus, an inspection capability of the display panel inspecting system 100 may be increased.

According to a luminance distortion compensating apparatus, a method of compensating for a luminance distortion using the luminance distortion compensating apparatus, and a display panel inspecting system having the luminance distortion compensating apparatus, a luminance distortion compensating apparatus eliminates a luminance distortion caused by a display panel inspecting apparatus from grayscale image data, and outputs pre-processed image data. Therefore, the luminance distortion caused by the display panel inspecting apparatus may be compensated. Thus, an inspection capability of the display panel inspecting system may be increased.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the teachings and aspects of the present inventive concept.

What is claimed is:

1. A luminance distortion compensating apparatus comprising:

an image data receiving circuit configured to receive grayscale image data from a grayscale image displayed on a display panel and to receive full white image data from a full white image displayed on a display panel; and a luminance distortion compensating circuit configured to compensate for a luminance distortion generated by a display panel inspecting apparatus inspecting the display panel, in the grayscale image data, using the grayscale image data and the full white image data, wherein the display panel is configured to display an image that has been compensated using the luminance distortion compensating circuit.

2. The luminance distortion compensating apparatus of claim 1, wherein the luminance distortion is generated by a spot of irregular illumination on a backlight unit included in the display panel inspecting apparatus, and the luminance distortion compensating circuit compensates the luminance distortion generated by the spot of irregular illumination on the backlight unit.

3. The luminance distortion compensating apparatus of claim 1, wherein the luminance distortion is generated by a jig included in the display panel inspecting apparatus, and the luminance distortion compensating circuit compensates for the luminance distortion generated by the jig.

4. A luminance distortion compensating apparatus comprising:

an image data receiving circuit configured to receive grayscale image data from a grayscale image displayed on a display panel and to receive full white image data from a full white image displayed on a display panel; and a luminance distortion compensating circuit configured to compensate for a luminance distortion generated by a display panel inspecting apparatus inspecting the display panel, in the grayscale image data, using the grayscale image data and the full white image data, wherein the luminance distortion compensating circuit receives the grayscale image data from the image data receiving circuit, calculates a first average luminance value of the grayscale image data, outputs the first average luminance value of the grayscale image data, receives the full white image data from the image data receiving circuit, calculates a second average luminance value of the full white image data, outputs a reciprocal value of the second average luminance value, performs a scaling on the full white image data such that a luminance of the full white image data corresponds to a luminance of the grayscale image data, outputs a scaling image data that results from the scaling, outputs luminance trend line data of the scaling image data, outputs luminance distortion data of the luminance distortion using the scaling image data and the luminance trend line data, and outputs pre-processed image data in which the luminance distortion is compensated for in the grayscale image data using the grayscale image data and the luminance distortion data.

5. The luminance distortion compensating apparatus of claim 4, wherein the luminance distortion compensating circuit comprises a first average luminance value calculating circuit configured to receive the grayscale image data from the image data receiving circuit, and further configured to calculate the first average luminance value of the grayscale image data to output the first average luminance value of the grayscale image data.

6. The luminance distortion compensating apparatus of claim 5, wherein the luminance distortion compensating circuit further comprises a second average luminance value calculating circuit configured to receive the full white image data from the image data receiving circuit, and further configured to calculate the second average luminance value of the full white image data and to output the reciprocal value of the second average luminance value.

7. The luminance distortion compensating apparatus of claim 6, wherein the luminance distortion compensating circuit further comprises a scaling image data outputting circuit configured to perform the scaling on the full white image data such that the luminance of the full white image data corresponds to the luminance of the grayscale image data and to output scaling image data.

8. The luminance distortion compensating apparatus of claim 7, wherein the scaling image data outputting circuit comprises a multiplexer configured to multiplex the first average luminance value of the grayscale image data, the reciprocal value of the second average luminance value of the full white image data and the full white image data to output the scaling image data.

9. The luminance distortion compensating apparatus of claim 7, wherein the luminance distortion compensating circuit further comprises a luminance trend line data generating circuit configured to receive the scaling image data, and to generate and output the luminance trend line data of the scaling image data and to output the luminance trend line data of the scaling image data.

10. The luminance distortion compensating apparatus of claim 9, wherein the luminance distortion compensating circuit further comprises a luminance distortion extracting circuit configured to output the luminance distortion data of the luminance distortion using the scaling image data and the luminance trend line data.

11. The luminance distortion compensating apparatus of claim 10, wherein the luminance distortion extracting circuit comprises a subtractor configured to subtract the scaling image data from the luminance trend line data to output the luminance distortion data.

12. The luminance distortion compensating apparatus of claim 10, wherein the luminance distortion compensating circuit further comprises a compensating circuit configured to output the pre-processed image data in which the luminance distortion is compensated in the grayscale image data using the grayscale image data and the luminance distortion data.

13. The luminance distortion compensating apparatus of claim 12, wherein the compensating circuit comprises an adder configured to add the luminance distortion data to the grayscale image data to output the pre-processed image data.

14. The luminance distortion compensating apparatus of claim 12, wherein the image data receiving circuit comprises: a grayscale image data receiving circuit configured to receive the grayscale image data; and a full white image data receiving circuit configured to receive the full white image data.

15. A method of compensating for a luminance distortion, the method comprising:

displaying a grayscale image and a full white image on a display panel;

measuring the display of the grayscale image and the full white image on the display panel to receive grayscale image data and full white image data, respectively;

compensating for a luminance distortion generated by a display panel inspecting apparatus inspecting the display panel, in the grayscale image data, using the grayscale image data and the full white image data; and displaying an image on the display panel using the compensation for the luminance distortion.

16. The method of claim 15, wherein the compensating of the luminance distortion comprises:

calculating a first average luminance value of the grayscale image data and outputting the first average luminance value of the grayscale image data;

calculating a second average luminance value of the full white image data and outputting a reciprocal value of the second average luminance value;

performing a scaling on the full white image data such that a luminance of the full white image data corresponds to a luminance of the grayscale image data and outputting scaling image data resulting from the scaling;

outputting luminance trend line data of the scaling image data;

outputting luminance distortion data of the luminance distortion using the scaling image data and the luminance trend line data; and outputting pre-processed image data in which the luminance distortion is compensated for in the grayscale image data using the grayscale image data and the luminance distortion data.

17. The method of claim 15, wherein the luminance distortion is generated by a spot of a backlight unit included in the display panel inspecting apparatus, and the compensating of the luminance distortion comprises compensating for the luminance distortion generated by the spot of the backlight unit.

18. The method of claim 15, wherein the luminance distortion is generated by a jig included in the display panel inspecting apparatus, and the compensating of the luminance distortion comprises compensating for the luminance distortion generated by the jig.

19. A display panel inspecting system comprising:

a display panel configured to display an image;

a display panel inspecting apparatus configured to inspect the display panel; and a luminance distortion compensating apparatus comprising an image data receiving circuit configured to generate grayscale image data and full white image data by sensing a grayscale image and a full white image displayed on a display panel, respectively, and a luminance distortion compensating circuit configured to compensate for a luminance distortion generated by the display panel inspecting apparatus, in the grayscale image data, using the grayscale image data and the full white image data, wherein the display panel is further configured to display a subsequent image that is compensated for using the luminance distortion compensating apparatus.

20. The display panel inspecting system of claim 19, wherein the luminance distortion compensating circuit receives the grayscale image data from the image data receiving circuit, calculates a first average luminance value of the grayscale image data and outputs the first average luminance value of the grayscale image data, receives the full white image data from the image data receiving circuit, calculates a second average luminance value of the full white image data and outputs a reciprocal value of the second average luminance value, performs a scaling on the full white image data such that a luminance of the full white image data corresponds to a luminance of the grayscale image data and outputs scaling image data resulting from the scaling, outputs luminance trend line data of the scaling image data, outputs luminance distortion data of the luminance distortion using the scaling image data and the luminance trend line data, and outputs pre-processed image data in which the luminance distortion is compensated in the grayscale image data using the grayscale image data and the luminance distortion data.

* * * * *